US010626878B2

(12) United States Patent
Masuda et al.

(10) Patent No.: US 10,626,878 B2
(45) Date of Patent: Apr. 21, 2020

(54) METHOD FOR INSPECTING ROTARY MACHINE, AND ROTARY MACHINE

(71) Applicant: MITSUBISHI HEAVY INDUSTRIES COMPRESSOR CORPORATION, Tokyo (JP)

(72) Inventors: Yuji Masuda, Hiroshima (JP); Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 122 days.

(21) Appl. No.: 15/562,076

(22) PCT Filed: Mar. 31, 2015

(86) PCT No.: PCT/JP2015/060177
§ 371 (c)(1),
(2) Date: Sep. 27, 2017

(87) PCT Pub. No.: WO2016/157425
PCT Pub. Date: Oct. 6, 2016

(65) Prior Publication Data

US 2018/0073513 A1 Mar. 15, 2018

(51) Int. Cl.
*B08B 9/027* (2006.01)
*F04D 27/00* (2006.01)
(Continued)

(52) U.S. Cl.
CPC ..... *F04D 27/001* (2013.01); *B08B 9/027* (2013.01); *F04B 51/00* (2013.01); *F04D 17/122* (2013.01); *F04D 29/70* (2013.01); *F04D 29/701* (2013.01); *B08B 2209/027* (2013.01); *F04D 29/08* (2013.01); *F05D 2260/607* (2013.01)

(58) Field of Classification Search
None
See application file for complete search history.

(56) References Cited

U.S. PATENT DOCUMENTS 5,293,218 A * 3/1994 Morris ..... G01N 33/2805 356/504
2010/0116732 A1* 5/2010 Jung ..... B01D 29/114 210/447

(Continued)

FOREIGN PATENT DOCUMENTS

JP 2014-141975 A 8/2014

OTHER PUBLICATIONS

International Search Report issued in corresponding International Application No. PCT/JP2015/060177 dated Jun. 16, 2015, with translation (5 pages).

(Continued)

*Primary Examiner* — Mikhail Kornakov
*Assistant Examiner* — Ryan L. Coleman
(74) *Attorney, Agent, or Firm* — Osha Liang LLP

(57) ABSTRACT

A method for inspecting a rotary machine having a flow path through which a fluid flows includes a step of measuring a width of the flow path by a non-contact sensor in a stationary component of the rotary machine at a position facing the flow path; and a step of determining whether or not the measured width of the flow path is less than a predetermined lower limit threshold.

4 Claims, 7 Drawing Sheets

(51) Int. Cl.

| | |
|---|---|
| ***F04B 51/00*** | (2006.01) |
| ***F04D 29/70*** | (2006.01) |
| ***F04D 17/12*** | (2006.01) |
| *F04D 29/08* | (2006.01) |

(56) References Cited

U.S. PATENT DOCUMENTS

| | | | | |
|---|---|---|---|---|
| 2012/0063918 | A1 | 3/2012 | de Larminat et al. | |
| 2015/0316402 | A1* | 11/2015 | Wee | G01F 1/363 73/861.04 |
| 2016/0199888 | A1* | 7/2016 | Jaaskelainen | C23C 14/54 134/18 |

OTHER PUBLICATIONS

Written Opinion of the International Searching Authority issued in corresponding International Application No. PCT/JP2015/060177 dated Jun. 16, 2015, with translation (9 pages).

* cited by examiner

METHOD FOR INSPECTING ROTARY MACHINE, AND ROTARY MACHINE

TECHNICAL FIELD

One or more embodiments of the present invention relates to a method for inspecting a rotary machine and a rotary machine.

BACKGROUND ART

In various plants, a centrifugal compressor for pumping a process gas is used. In a case where a process gas is pumped by a centrifugal compressor, according to a kind of the process gas, components in the gas react and polymeric or coke-shaped solid matters may be generated in a flow path. In addition, an increase in a temperature of a process gas in a compression step may influence the generation of the solid matters.

If the solid matters attached to a flow path or a rotating member of a centrifugal compressor, the attached solid matters adversely affect a flow in the flow path or decrease performance. In addition, if attachment or separation of the solid matters is generated, balance in the rotating member is lost, which generates vibrations.

Accordingly, for example, PTL 1 discloses a configuration in which a spray-type nozzle is installed to remove solid matters attached to and deposited on a flow path of a centrifugal compressor and an atomized cleaning solution is injected into a flow path.

CITATION LIST

Patent Literature

[PTL 1] Japanese Unexamined Patent Application Publication No. 2014-141975

However, as described in PTL 1, in the configuration in which the cleaning solution is injected from the nozzle into the flow path, it is difficult to determine at what timing the cleaning solution should be injected. Therefore, in order to check the states of attachment and deposition of solid matters in the flow path, it is necessary to disassemble the centrifugal compressor or the like to directly view the inside of the flow path, which is troublesome and costly. In addition, during the checking work, it is not possible to operate the compressor, which generates a decrease in an operation rate.

SUMMARY OF THE INVENTION

One or more embodiments of the present invention provide a method for inspecting a rotary machine and a rotary machine capable of decreasing a labor and costs of maintenance and improving an operation rate of compressibility by easily checking states of attachment and deposition of solid matters in a flow path.

According to a first aspect of the present invention, there is provided a method for inspecting a rotary machine which is a method for inspecting a rotary machine having a flow path through which a fluid flows, the method including: a step of measuring a width of the flow path by a non-contact sensor provided in a stationary component of the rotary machine at a position facing the flow path; and a step of determining whether or not the measured width of the flow path is less than a predetermined lower limit threshold.

According to one or more embodiments of this configuration, by measuring the width of the flow path formed in the casing of the rotary machine using the non-contact sensor without disassembling the rotary machine, it is possible to check the states of attachment and deposition of solid matters in the flow path.

Specifically, if solid matters are attached to a wall surface of the flow path, the width of the flow path is narrowed. Accordingly, if the measured width of the flow path is less than the predetermined lower limit threshold, it is possible to easily determine that the solid matters are attached to the flow path by equal to or more than a certain amount.

In the method for inspecting a rotary machine according to a second aspect of the present invention, in the first aspect, the method may further include a step of removing solid matters attached to the inside of the flow path by injecting a cleaning solution into the flow path when the measured width of the flow path is less than the predetermined lower limit threshold.

According to one or more embodiments of this configuration, by injecting the cleaning solution so as to remove the solid matters in a case where the solid matters are attached to the flow path equal to or more than a certain amount, it is possible to remove the solid matters at appropriate timing.

In the method for inspecting a rotary machine according to a third aspect of the present invention, in the second aspect, the width of the flow path may be measured by the non-contact sensor while the step of removing the solid matters is performed, and the step of removing the solid matters may end in a case where the measured width of the flow path is equal to or more than a predetermined upper limit threshold.

In one or more embodiments, since the attached solid matters are removed during the removal processing of the solid matters, the width of the flow path is widened. In a case where the width of the flow path is equal to or more than the upper limit threshold and the attached solid matters are removed by equal to or more than a predetermined reference, it is possible to end the removal of the solid matters. Accordingly, it is possible to more effectively perform the removal processing of the solid matters by decreasing a usage amount of the cleaning solution.

According to a fourth aspect of the present invention, there is provided a rotary machine, including: a casing which includes a flow path through which a fluid flows; and a non-contact sensor is provided in a stationary component of the casing at a position facing the flow path to measures a width of the flow path.

According to one or more embodiments of this configuration, it is possible to detect the width of the flow path by the non-contact sensor even in a state where the rotary machine is operated. Accordingly, it is possible to check the state of attachment and deposition of the solid matters in the flow path without disassembling the rotary machine.

In the rotary machine according to a fifth aspect of the present invention, in the fourth aspect, the rotary machine may further: an injection device which includes a nozzle which injects a cleaning solution removing solid matters attached to the inside the flow path; and a control unit which controls an operation of the injection device according to the width of the flow path measured by the non-contact sensor.

In one or more embodiments, in a case where many solid matters are attached, it is possible to automatically perform the removal processing of the solid matters by operating the injection device using the control of the control unit. In addition, it is possible to automatically stop the removal processing in the step in which the attached solid matters are removed.

According to one or more embodiments of the above-described method for inspecting a rotary machine and the rotary machine, it is possible to decrease a labor and costs of maintenance and improve an operation rate of compressibility by easily checking the states of attachment and deposition of the solid matters in the flow path.

DETAILED DESCRIPTION OF EMBODIMENTS

Figure 1:
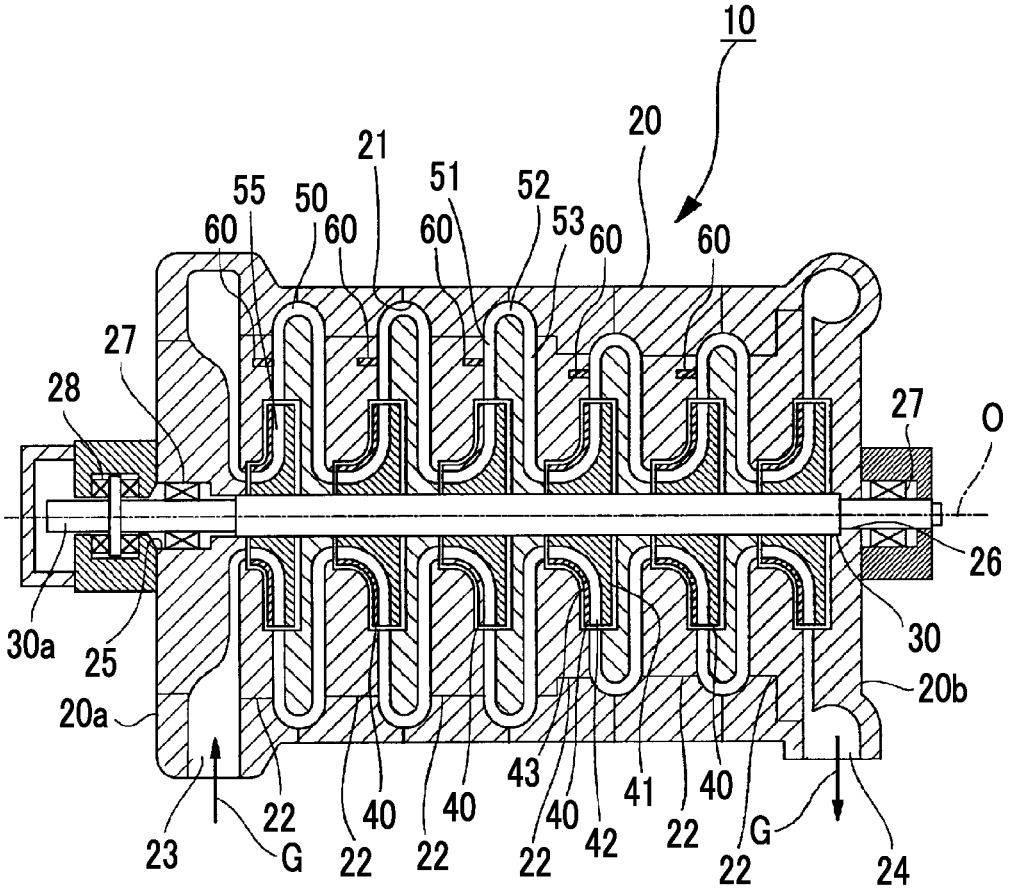
FIG. 1 is a sectional view showing a configuration of a centrifugal compressor which is an example of a rotary machine according to one ore more embodiments of the present invention.

As shown in FIG. 1, a centrifugal compressor (rotary machine) 10 in accordance with one or more embodiments mainly includes a casing 20, a rotary shaft 30 which is rotatably supported around a center axis O in the casing 20, and impellers 40 which are attached to the rotary shaft 30 and compress a process gas (fluid) G using a centrifugal force.

A plurality of ring members (diaphragms) 22 which are arranged in a direction of a center axis O of the rotary shaft are provided in the casing 20. In addition, an internal space 21 in which an increase in a diameter and a decrease in a diameter are repeated is provided in the casing 20. The impellers 40 are accommodated in the internal space 21. When the impellers 40 are accommodated, a stationary component side flow path 50 through which the process gas G flowing through the impellers 40 flows from an upstream side toward a downstream side is formed at a position between the impellers 40.

A suction port 23 through which the process gas G flows from the outside to the stationary component side flow path 50 is provided on one end portion 20*a* of the casing 20. In addition, a discharge port 24 which is continued to the stationary component side flow path 50 and through which the process gas G flows to the outside is provided on the other end portion 20*b* of the casing 20.

Support holes 25 and 26 which support both end portions of the rotary shaft 30 are formed on the one end portion 20*a* side and the other end portion 20*b* side of the casing 20. The rotary shaft 30 is rotatably supported by the support holes 25 and 26 around the center axis O via journal bearings 27. In addition, a thrust bearing 28 is provided on the one end portion 20*a* of the casing 20 and one end side 30*a* of the rotary shaft 30 is rotatably supported in the direction of the center axis O via the thrust bearing 28.

The plurality of impellers 40 are accommodated in the respective ring members 22 in the casing 20 at intervals therebetween in the direction of the center axis O of the rotary shaft 30. In addition, FIG. 1 shows an example in which six impellers 40 are provided. However, at least one impeller 40 may be provided.

Figure 2:
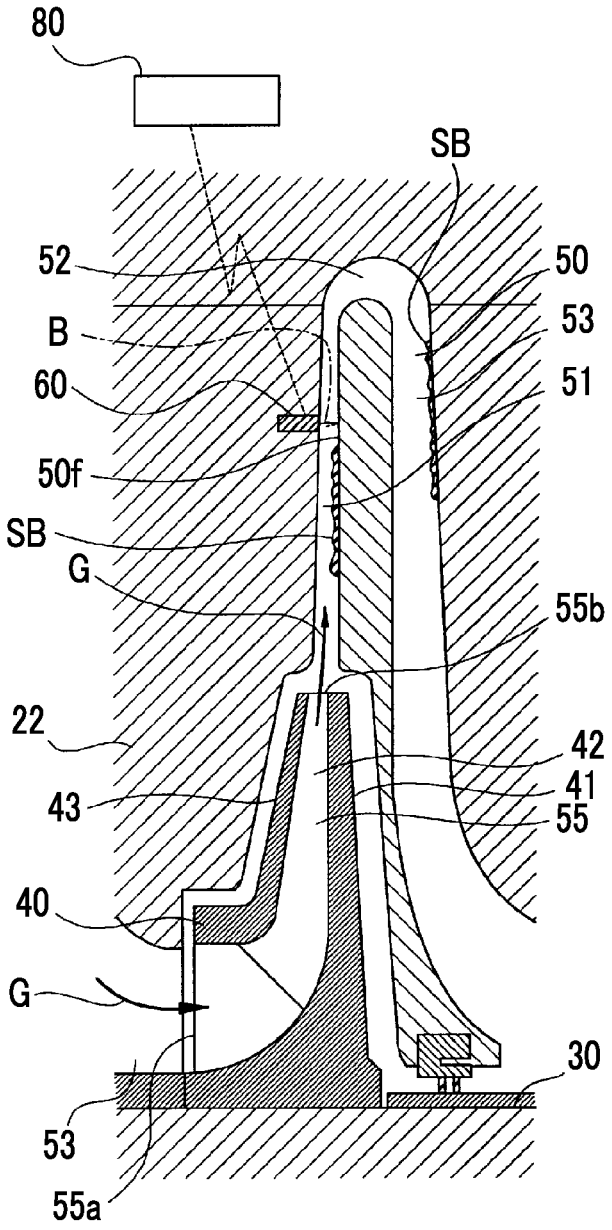
FIG. 2 is an enlarged sectional view showing a main portion of the centrifugal compressor.

As shown in FIG. 2, each of the impellers 40 is a so-called closed impeller which includes a disk portion 41, a plurality of blade portion 42, and a cover portion 43, but may be an open impeller in which the cover portion 43 is not provided.

The stationary component side flow path 50 includes a diffuser portion 51, a return bend portion 52, and a return flow path portion 53.

The diffuser portion 51 is formed to extend from the outer peripheral side of the impeller 40 toward the outer peripheral side of the casing 20.

The return bend portion 52 is formed continuously to the outer peripheral portion of the diffuser portion 51. The return bend portion 52 is formed to go around from the outer peripheral portion of the diffuser portion 51 to the other end portion 20*b* side of the casing 20 in a U shape in a sectional view and to be directed toward the inner peripheral side.

The return flow path portion 53 is formed from the return bend portion 52 toward the inner peripheral side.

In each impeller 40, an impeller side flow path 55 is formed in a space which is surround by the disk portion 41, the cover portion 43, and the blade portions 42 adjacent to each other in the circumferential direction. In each impeller 40, the impeller side flow path 55 is formed such that an end portion 55*a* of the impeller side flow path 55 facing the one end portion 20*a* side of the casing 20 faces the end portion of the return flow path portion 53 of the stationary component side flow path 50, and an end portion 55*b* opposite to the end portion 55*a* faces the outer peripheral side and faces the diffuser portion 51 of the stationary component side flow path 50.

In the centrifugal compressor 10, the process gas G introduced from the suction port 23 into the stationary component side flow path 50 flows from the end portion 55*a* close to the inside in the radial direction of the blade portion 42 into the impeller side flow path 55 in each of the impellers 40 rotating around the center axis O along with the rotary shaft 30. The process gas G flowing into the impeller side flow path 55 flows out from the end portion 55*b* close to the outside in the radial direction of the blade portion 42 toward the outer peripheral side. In addition, the process gas G flows through the impeller side flow path 55 toward the outside in the radial direction, and thus, the process gas G is compressed.

The process gas G flowing out from the impellers 40 of each stage flows the outer peripheral side through the diffuser portion 51 of the stationary component side flow path 50, the flow direction of the process gas G is turned back in the return bend portion 52, and the process gas G are fed into the impellers 40 of the latter stage side through the return flow path portion 53. In this way, the process gas G passes through the impeller side flow paths 55 and the stationary component side flow paths 50 of the impellers 40 provided in multiple stages from the one end portion 20*a* side of the casing 20 toward the other end portion 20*b* side thereof, and thus, the process gas G is compressed in multiple stages and is discharged from the discharge port 24.

In the centrifugal compressor 10, a sensor 60 is provided in the casing 20 at a position facing the stationary component side flow path 50. In order to detect a thickness of solid matters SB (refer to FIG. 2) attached to the inner peripheral surface of the stationary component side flow path 50, the sensor 60 measures a width (a width in a direction intersecting a flow direction of the process gas G) of the stationary component side flow path 50. The sensor 60 is a non-contact sensor and possibly, is a sensor which emits infrared rays or laser light as measurement light B.

The sensor 60 is installed on one side (the suction portion 23 side in the direction of the center axis O) of the stationary component side flow path 50. The sensor 60 emits the measurement light B including infrared rays or laser light in a direction orthogonal to the other inner peripheral surface 50*f* of the stationary component side flow path 50 and receives reflective light. In this way, the sensor 60 detects the width of the stationary component side flow path 50. That is, if the solid matters SB are not attached to the inner peripheral surface 50*f* of the stationary component side flow path 50, a distance from the sensor 60 to the inner peripheral surface 50*f* is measured as the width of the flow path by the sensor 60. In addition, if the solid matters SB are attached to the inner peripheral surface 50*f* of the stationary component side flow path 50, a distance from the sensor 60 to the surfaces of the solid matters SB is measured as the width of the flow path by the sensor 60.

The sensor 60 is provided in a stationary portion of the centrifugal compressor 10 which is not integrally rotated with the rotary shaft 30. For example, the sensor 60 is provided at the position facing the diffuser portion 51 positioned on the outer peripheral side of the impeller 40 of each stage.

In addition, the sensor 60 may be provided at a position facing the position at which the solid matters SB are easily attached in a state where the stationary component side flow path 50 is interposed therebetween.

In addition, the sensor 60 sends the measured results obtained by the irradiation of the measurement light B to a measurement device main body 80 provided outside the centrifugal compressor 10 wirelessly or by wires. In a case where the sensor 60 is connected to the measurement device main body 80 by wires, it is necessary to provide a seal member, by which seal properties are secured, at a portion though which a signal line connected to the sensor 60 passes the casing 20 of the centrifugal compressor 10. Meanwhile, in a case where the sensor 60 is connected to the measurement device main body 80 wirelessly, the above-described configuration is not required.

Figure 3:
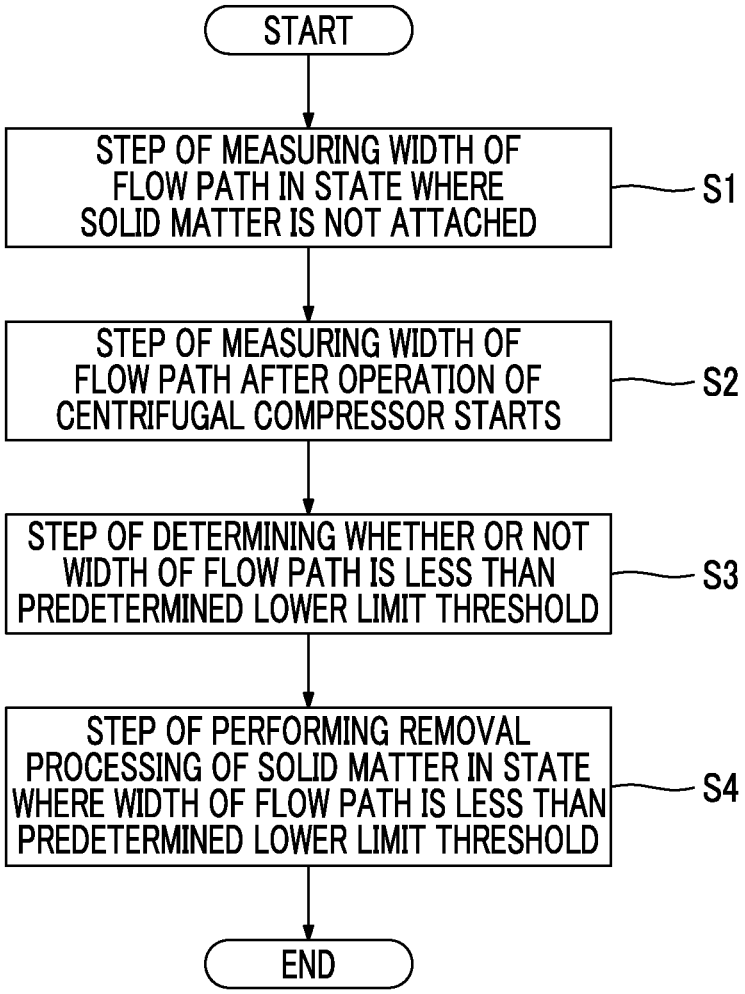
FIG. 3 is a flowchart showing a procedure of a method for inspecting a centrifugal compressor.

Next, a method for inspecting the centrifugal compressor 10 will be described with reference to FIG. 3.

In the centrifugal compressor 10 having the sensor 60, before the centrifugal compressor 10 is installed, immediately after the centrifugal compressor 10 is installed, or the like, the width of the stationary component side flow path 50 is measured in a state where the solid matters SB are not attached to the inner peripheral surface 50*f* of the stationary component side flow path 50 (Step S1).

Next, at appropriate timing after the operation of the centrifugal compressor 10 starts, the width of the stationary component side flow path 50 is measured by the sensor 60 (Step S2). The measurement of the width of the flow path performed by the sensor 60 may be periodically performed at a predetermined interval or may be performed at every minute time interval during the operation of the centrifugal compressor 10.

In addition, it is determined whether or not the width of the flow path measured by the sensor 60 is less than a predetermined lower limit threshold (Step S3). In a case where the width of the flow path is less than the predetermined lower limit threshold, the solid matters SB having a thickness of a reference value or more in advance are attached to the inner peripheral surface 50*f* of the stationary component side flow path 50. Accordingly, in the case where the width of the flow path measured by the sensor 60 is less than the predetermined lower limit threshold, since it is determined that the solid matters SB are attached to the inner peripheral surface 50*f* of the stationary component side flow path 50, removal processing of the solid matters SB are performed (Step S4).

In the removal processing of the solid matters SB, a method of injecting a cleaning solution to the inner peripheral surface 50*f* of the stationary component side flow path 50 using an oil injection device (not shown) which injects a cleaning oil or the like as the cleaning solution is exemplified.

Here, in the case where the width of the flow path measured by the sensor 60 is less than the predetermined lower limit threshold, the measurement device main body 80 may output an alarm signal indicating that the removal processing of the solid matters SB is required to the outside using sounds, flashing of a lamp, display of a message, or the like.

According to the method for inspecting the centrifugal compressor 10 and the centrifugal compressor 10 of the above-described embodiments, the sensor 60 which detects the width of the stationary component side flow path 50 formed in the casing 20 of the centrifugal compressor 10 is provided. Accordingly, it is possible to check the states of attachment and deposition of the solid matters SB in the stationary component side flow path 50 without disassembling the centrifugal compressor 10, and thereby, it is possible to decrease a labor and costs of maintenance.

In addition, even in a state where the centrifugal compressor 10 is operated, it is possible to detect the width of the stationary component side flow path 50 by the sensor 60. Therefore, it is possible to improve an operation rate of the centrifugal compressor 10.

In addition, in a case where it is determined that the solid matters SB are to be removed from the inside of the stationary component side flow path 50 based on the detected result of the sensor 60 with respect to the width of the stationary component side flow path 50, the cleaning solution is injected into the stationary component side flow path 50 by the oil injection device to remove the solid matters SB. Accordingly, it is possible to inject the cleaning solution at appropriate timing to remove the solid matters SB. As a result, it is possible to minimize an injection amount of the cleaning solution.

Here, in one or more embodiments, the sensor 60 may be installed on the other side (the discharge port 24 side in the direction of the center axis O) of the stationary component side flow path 50.

Next, additional embodiments of the method for inspecting the centrifugal compressor 10 and the centrifugal compressor 10 according to the present invention will be described.

The centrifugal compressor 10 shown in one or more embodiments below is different from that of the above-described embodiments in that an oil injection device (injection device) and the measurement device main body 80 having a control unit 80*a* and a determination unit 80*b* are provided in addition to the sensor 60 shown in the above-described embodiments. Accordingly, in one or more embodiments, the same reference numerals are assigned to the same portions as those of the above-described embodiments, and overlapping descriptions thereof are omitted.

Figure 4:
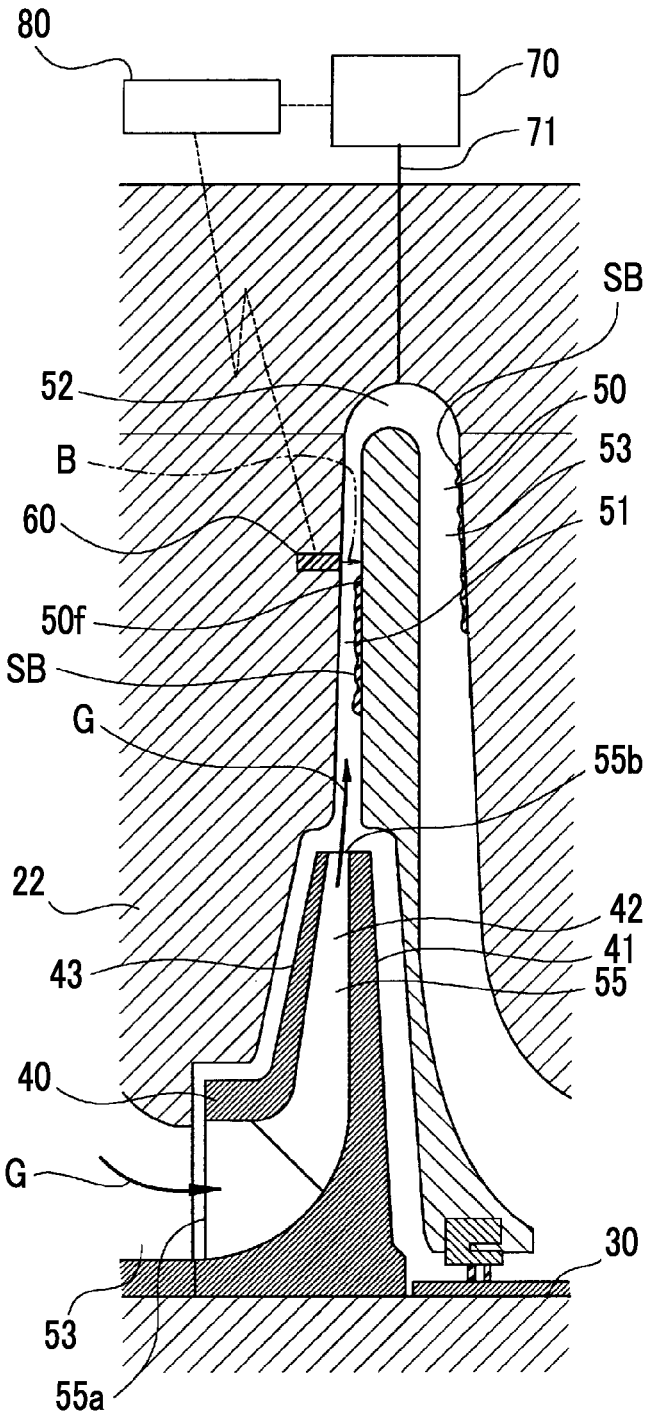
FIG. 4 is an enlarged sectional view showing a main portion of a centrifugal compressor in one or more embodiments of the present invention.

As shown in FIG. 4, in the centrifugal compressor 10 in one or more embodiments, the sensor 60 which detects the width of the stationary component side flow path 50 is provided at the position facing the stationary component side flow path 50, for example, the position facing the diffuser portion 51 positioned on the outer peripheral side of the impeller 40 of each stage.

In addition, the sensor 60 sends the measured results obtained by the irradiation of the measurement light B to the measurement device main body 80 provided outside the centrifugal compressor 10 wirelessly or by wires.

The centrifugal compressor 10 includes the oil injection device 70 which injects a cleaning solution such as a cleaning oil into the stationary component side flow path 50 from the outside of the casing 20. The oil injection device 70 includes a nozzle 71 which injects the cleaning solution, and for example, the leading end portion of the nozzle 71 is installed to be positioned on the outer peripheral side of the return bend portion 52 of the stationary component side flow path 50.

In the centrifugal compressor 10 having the sensor 60 and the oil injection device 70, before the centrifugal compressor is installed, immediately after the centrifugal compressor is installed, or the like, the width of the stationary component side flow path 50 is measured in a state where the solid matters SB are not attached to the inner peripheral surface 50*f* of the stationary component side flow path 50, and the measured results are stored in the measurement device main body 80.

Figure 5:
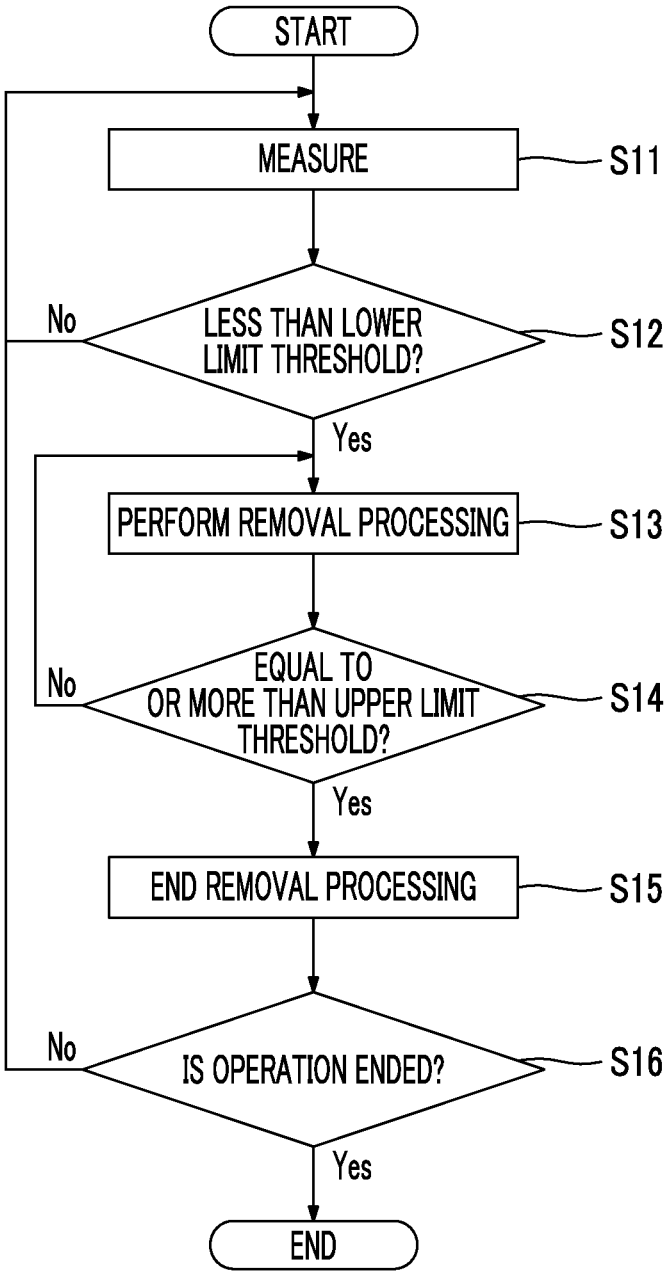
FIG. 5 is a flowchart when observing a state of attachment of solid matters and performing the removal processing of the solid matters in the centrifugal compressor.

As shown in FIG. 5, at appropriate timing after the operation of the centrifugal compressor 10 starts, the width of the stationary component side flow path 50 is measured by the sensor 60 (Step S11). The measurement of the width of the flow path performed by the sensor 60 may be periodically performed at a predetermined interval or the measurement of the width of the flow path may be performed at all times by the sensor 60 during the operation of the centrifugal compressor 10.

The measurement device main body 80 determines whether or not the width of the flow path measured by the sensor 60 is less than a predetermined lower limit threshold (Step S12). The measurement of the width of the flow path in Step S11 is repeated as long as the measure width of the flow path is equal to or more than the lower limit threshold.

In a case where the measured width of the flow path is less than the lower limit threshold, since it is determined that the solid matters SB having a thickness of a reference value or more in advance are attached to the inner peripheral surface 50*f* of the stationary component side flow path 50, the removal processing of the solid matters SB is performed (Step S13). In the removal processing of the solid matters SB, cleaning oil or like is injected from the nozzle 71 of the oil injection device 70 into the stationary component side flow path 50 as a cleaning solution.

The measurement device main body 80 measures the width of the flow path by the sensor 60 while the removal processing of the solid matters SB is performed and determines whether or not the measured width of the flow path is equal to or more than a predetermined upper limit threshold (Step S14).

Since it is determined that the solid matters SB are still attached to the inner peripheral surface 50*f* of the stationary component side flow path 50 as long as the measured width of the flow path is less than the upper limit threshold, the removal processing of the solid matters SB is continuously performed.

In a case where the measured width of the flow path is equal to or more than the upper limit threshold, the injection of the cleaning solution from the nozzle 71 stops, and the removal processing of the solid matters SB attached to the inner peripheral surface 50*f* of the stationary component side flow path 50 ends (Step S15).

Thereafter, the series of processing is continuously performed until the operation of the centrifugal compressor 10 ends (Step S16).

According to the method for inspecting the centrifugal compressor 10 and the centrifugal compressor 10 of the above-described embodiments, the sensor 60 which detects the width of the stationary component side flow path 50 is provided, the oil injection device 70 which includes the nozzle 71 injecting the cleaning solution for removing the solid matters SB attached to the inside the stationary component side flow path 50, and the measurement device main body 80 which controls the operation of the oil injection device 70 according to the width of the stationary component side flow path 50 measured by the sensor 60 are provided.

Accordingly, by checking the states of attachment and deposition of the solid matters SB in the stationary component side flow path 50 without disassembling the centrifugal compressor 10, in a case where many solid matters SB are attached, it is possible to operate the oil injection device 70 to automatically perform the removal processing of the solid matters SB. Accordingly, it is possible to decrease a labor and costs of maintenance.

Moreover, the sensor 60 can detect the width of the stationary component side flow path 50 even in a state where the centrifugal compressor 10 is operated. Accordingly, it is possible to improve the operation rate of the centrifugal compressor 10.

Moreover, since the removal of the solid matters SB ends in the case where the width of the flow path is equal or more than the upper limit threshold during the removal processing of the solid matters SB, it is possible to more effectively perform the removal processing of the solid matters SB by decreasing a usage amount of the cleaning solution.

In addition, the present invention is not limited to the above-described embodiments and the design thereof can be modified within a scope which does not depart from the gist of the present invention.

Figure 6:
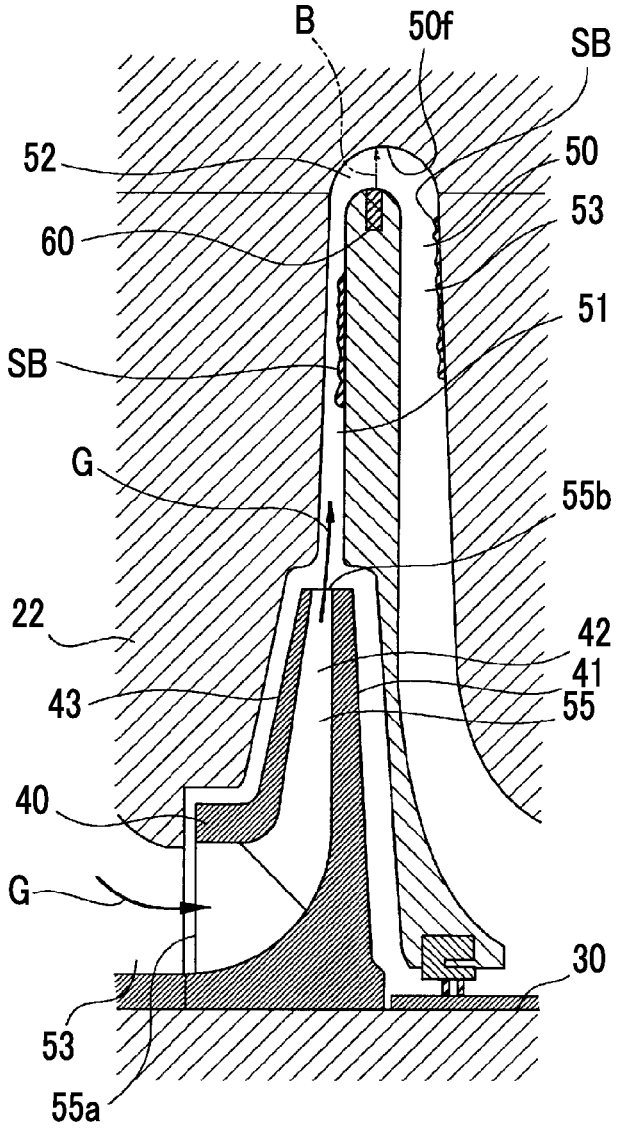
FIG. 6 is a view showing a modification example in which a sensor is provided at a different position in the rotary machines of one or more embodiments.

For example, the installation position of the sensor 60 is not limited to the diffuser portion 51. For example, as shown in FIG. 6, the sensor 60 may be provided in the inside of the radial direction of the return bend portion 52. Accordingly, the attachment amount of the solid matters SB which are easily deposited on the outer peripheral side of the return bend portion 52 can be measured by the sensor 60.

Figure 7:
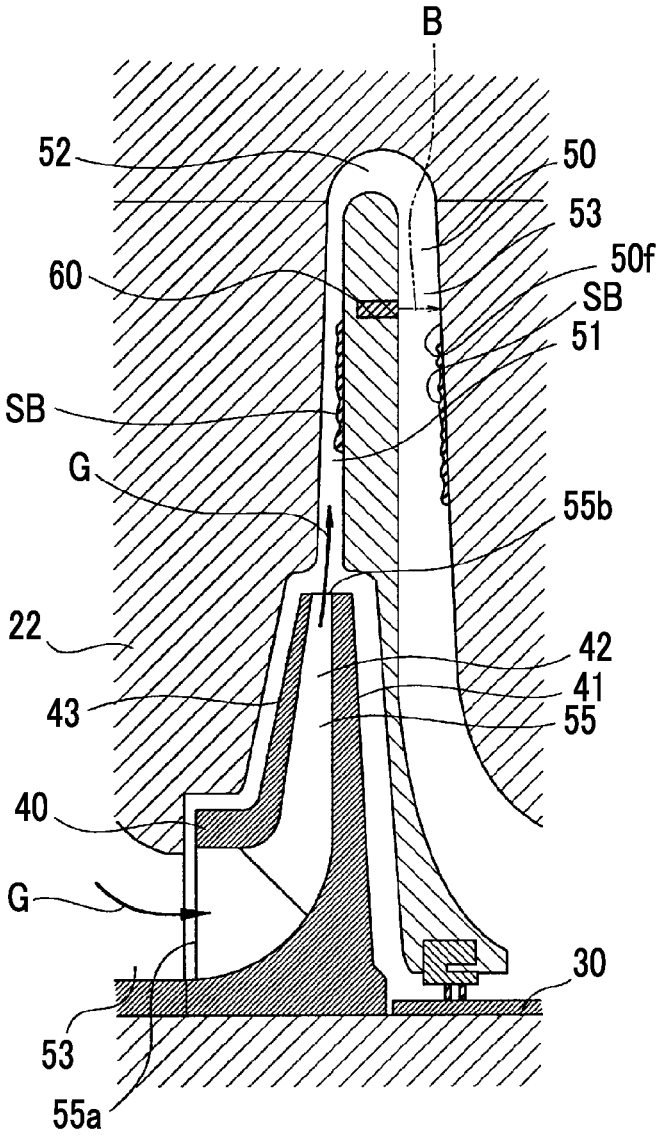
FIG. 7 is a view showing another modification example in which a sensor is provided at a different position in the rotary machines of one or more embodiments.

In addition, for example, as shown in FIG. 7, the sensor 60 may be provided in the return flow path portion 53. In the example of FIG. 7, the sensor 60 is provided on the suction port 23 side of the return flow path portion 53 in the direction of the center axis O. However, the sensor 60 may be provided on the discharge port 24 side of the return flow path portion 53 in the direction of the center axis O.

In addition, the sensor 60 may be provided at any position of the stationary component side flow path 50 positioned on the outer peripheral side with respect to the rotary shaft 30 in the circumferential direction around the rotary shaft 30. In addition, a plurality of sensors 60 may be provided at intervals therebetween in the circumferential direction. That is, the sensor 60 may be provided at any position of a stationary component.

Moreover, the configuration of the centrifugal compressor 10 is merely a schematic configuration in the above-described embodiments, and may be appropriately changed.

INDUSTRIAL APPLICABILITY

By measuring the width of the flow path using the non-contact sensor provided at the position facing the flow path of the rotary machine, it is possible to decrease a labor and costs of maintenance and improving the operation rate of compressibility by easily checking states of attachment and deposition of solid matters in the flow path.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

10: centrifugal compressor (rotary machine)
20: casing
20*a*: one end portion
20*b*: other end portion
21: internal space
22: ring member
23: suction port
24: discharge port
25, 26: support hole
27: journal bearing
28: thrust bearing
30: rotary shaft
30*a*: one end side
40: impeller
41: disk portion
42: blade portion
43: cover portion
50: stationary component side flow path (flow path)
50*f*: inner peripheral surface
51: diffuser portion
52: return bend portion
53: return flow path portion
55: impeller side flow path
55*a*: end portion
55*b*: end portion
60: sensor
70: oil injection device (injection device)
71: nozzle
80: measurement device main body
80*a*: control unit
80*b*: determination unit
B: measurement light
G: process gas (fluid)
O: center axis
SB: solid matter

The invention claimed is:

1. A method for inspecting a centrifugal compressor having a flow path through which a fluid flows, the method comprising:

measuring a width of the flow path by a non-contact sensor embedded in a wall of a stationary component of the centrifugal compressor at a position facing the flow path; and determining whether the measured width of the flow path is less than a predetermined lower limit threshold, wherein the non-contact sensor measures the width of the flow path by emitting a measurement light from a first side of the flow path to a second side of the flow path and receiving a reflective light reflected by the second side of the flow path; and initiating cleaning of the flow path if the measured width of the flow path is less than the predetermined lower limit threshold.

2. The method for inspecting a centrifugal compressor according to claim 1, wherein the cleaning of the flow path comprises:

removing solid matters attached to the inside of the flow path by injecting a cleaning solution into the flow path.

3. The method for inspecting a centrifugal compressor according to claim 2, wherein the width of the flow path is measured by the non-contact sensor while the removing of the solid matters is performed, and wherein the removing of the solid matters ends in a case where the measured width of the flow path is equal to or more than a predetermined upper limit threshold.

4. A centrifugal compressor, comprising:

a casing comprising a flow path through which a fluid flows in the centrifugal compressor; and a non-contact sensor embedded in a wall of a stationary component of the casing at a position facing the flow path to measure a width of the flow path, wherein the non-contact sensor measures the width of the flow path by emitting a measurement light from a first side of the flow path to a second side of the flow path and receiving a reflective light reflected by the second side of the flow path;

an injection device comprising a nozzle that is configured to inject into the flow path for the purpose of removing solid matters attached to inner surfaces of the flow path; and a controller configured to control operation of the injection device according to the width of the flow path measured by the non-contact sensor.

* * * * *